US009242365B1

(12) United States Patent
Bureau

(10) Patent No.: US 9,242,365 B1
(45) Date of Patent: Jan. 26, 2016

(54) EXTENSION IMPLEMENT FOR A PNEUMATICALLY ACTUATED BUFFER

(71) Applicant: Denis Bureau, Boisbriand (CA)

(72) Inventor: Denis Bureau, Boisbriand (CA)

( * ) Notice: Subject to any disclaimer, the term of this patent is extended or adjusted under 35 U.S.C. 154(b) by 0 days.

(21) Appl. No.: 14/455,914

(22) Filed: Aug. 10, 2014

(30) Foreign Application Priority Data

Sep. 5, 2013 (GB) ..... 1315767.2

(51) Int. Cl.
*B24B 23/00* (2006.01)
*B24B 41/00* (2006.01)
*B25G 1/04* (2006.01)

(52) U.S. Cl.
CPC ..... *B25G 1/04* (2013.01)

(58) Field of Classification Search
CPC ..... B24B 23/00; B24B 41/00; B25G 1/04
USPC ..... 451/344, 359, 358, 357, 162, 354
See application file for complete search history.

(56) References Cited

U.S. PATENT DOCUMENTS 2,702,395 A 2/1955 Zaiger
3,785,092 A 1/1974 Hutchins
3,985,188 A * 10/1976 Steele ..... B25C 7/00 173/170
4,782,632 A 11/1988 Matechuk
4,974,371 A 12/1990 Conboy
5,070,576 A 12/1991 Banta
D375,885 S 11/1996 Taylor
5,690,545 A 11/1997 Clowers et al.
5,860,216 A 1/1999 Shellnutt
5,926,913 A 7/1999 Hernandez et al.
D564,322 S 3/2008 Wright et al.
D573,431 S 7/2008 Wright et al.
7,625,264 B1 12/2009 Gordon
2006/0073777 A1 * 4/2006 Dotta ..... B24B 23/00 451/354
2007/0074882 A1 * 4/2007 Davis ..... B25C 7/00 173/18
2010/0048108 A1 * 2/2010 Stott ..... B24B 23/005 451/344

* cited by examiner

*Primary Examiner* — Robert Rose

(57) ABSTRACT

An extension frame for a pneumatically actuated buffer, further comprised of an elongated hollow post member; a receptacle removably connected at a distal end of the post member and adapted to releasably hold the buffer thereon; a rod member adapted to be slidably inserted within the post member and having a length that is longer than the post member; a palm handle assembly including an upper part removably connected to a proximal end of the post member, and a bottom part removably connected to a proximal end of the rod member. The palm handle assembly is adapted to push the rod member in a direction toward the receptacle. A biasing member is placed between the bottom part of the palm handle assembly and the receptacle and configured to bias the rod member in a direction away from the receptacle. A nipple member positioned within and extending through a bottom portion of the receptacle, such that when the bottom part of the palm handle assembly is pushed upwards and towards the upper part of the palm handle assembly the rod member is pushed upwards and the nipple member thereby moves upwards and into the receptacle in order to contact a trigger of the buffer to thereby activate the buffer, and when it is desired to deactivate the buffer.

18 Claims, 6 Drawing Sheets

FIG. 3a
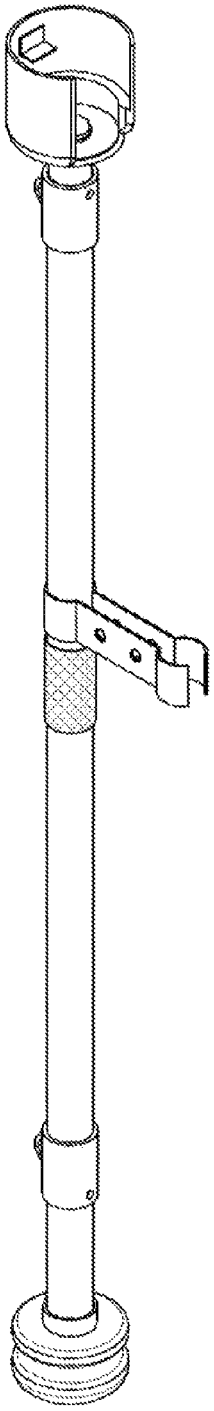
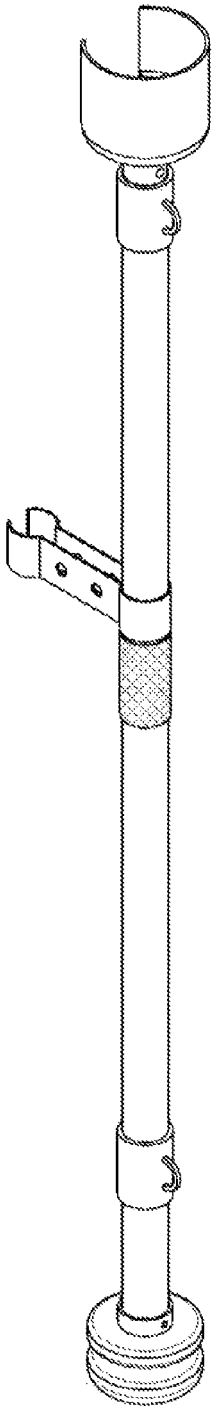
FIG. 3b

EXTENSION IMPLEMENT FOR A PNEUMATICALLY ACTUATED BUFFER

This application claims priority based on request GB1315767.2 filed Sep. 5, 2013

FIELD OF THE INVENTION

The present invention relates generally to accessories for hand tools but more particularly to an extension implement for a pneumatically actuated buffer.

BACKGROUND OF THE INVENTION

When buffing or polishing certain surfaces, a standard buffer is not ideally suited. It is sometimes preferable to use some sort of extension or accessory to facilitate the use of such a device. For example, an extension that extends the reach of a buffer. There is no such device currently on the market.

SUMMARY OF THE INVENTION

In view of the foregoing disadvantages inherent in the known devices now present in the prior art, the present invention, which will be described subsequently in greater detail, is to provide objects and advantages which are:

To provide for an extension for a pneumatically or electrically actuated buffer to sand or polish a surface. More specifically to reach areas above the head of the intended user.

In order to do so, the invention comprises an extension frame for a pneumatically actuated buffer, further comprised of an elongated hollow post member; a receptacle removably connected at a distal end of the post member and adapted to releasably hold the buffer thereon; a rod member adapted to be slidably inserted within the post member and having a length that is longer than the post member; a palm handle assembly including an upper part removably connected to a proximal end of the post member, and a bottom part removably connected to a proximal end of the rod member. The palm handle assembly is adapted to push the rod member in a direction toward the receptacle. A biasing member is placed between the bottom part of the palm handle assembly and the receptacle and configured to bias the rod member in a direction away from the receptacle. A nipple member positioned within and extending through a bottom portion of the receptacle, such that when the bottom part of the palm handle assembly is pushed upwards and towards the upper part of the palm handle assembly the rod member is pushed upwards and the nipple member thereby moves upwards and into the receptacle in order to contact a trigger of the buffer to thereby activate the buffer, and when it is desired to deactivate the buffer. The biasing member is adapted and allowed to push the bottom part of the palm handle assembly and thereby the rod member away from the receptacle thereby allowing the nipple member to move downwards and away from the trigger of the buffer to thereby deactivate the buffer.

The extension frame has the receptacle further include a tab member adapted to more securely removably hold a head portion of the buffer therein.

A handle member is attached to an outer surface of the post member and adapted to allow a user to grab the handle member with one hand and the palm handle assembly with their other hand.

The extension frame is further comprised of a clamp member attached to an outer surface of the post member and adapted to releasably hold a pneumatic hose member of the buffer adjacent to the extension frame.

Preferably, an upper ring releasably and adjustably attached between the distal end of the post member and the bottom portion of the receptacle, and a lower ring releasably and adjustably attached between the proximal end of the post member and the upper part of the palm handle assembly, to thereby provide a mechanism to releasably and adjustably hold the respective parts of the extension frame together.

The extension frame is further comprised of a blocking member adapted to be releasably secured to a location upon the rod member and adapted to press and compress the biasing member to a desired tension. The biasing member is preferably formed as a coil spring.

In a preferred embodiment, the post member, the bottom portion of the receptacle, the upper and lower parts of the palm handle assembly, the upper and lower rings, are formed in hollow cylindrical shapes.

The extension frame has the nipple member is formed in a cylindrical shape such that it snugly and slidably fits within the interior of the cylindrical shape of the bottom portion of the receptacle.

The extension frame is used in combination with a pneumatically actuated buffer, including a buffer head, a trigger for activating and deactivating the buffer, and a pneumatic hose.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 3*a-b* Isometric views favoring the front and the rear.

DETAILED DESCRIPTION OF THE PREFERRED EMBODIMENT

Figure 1:
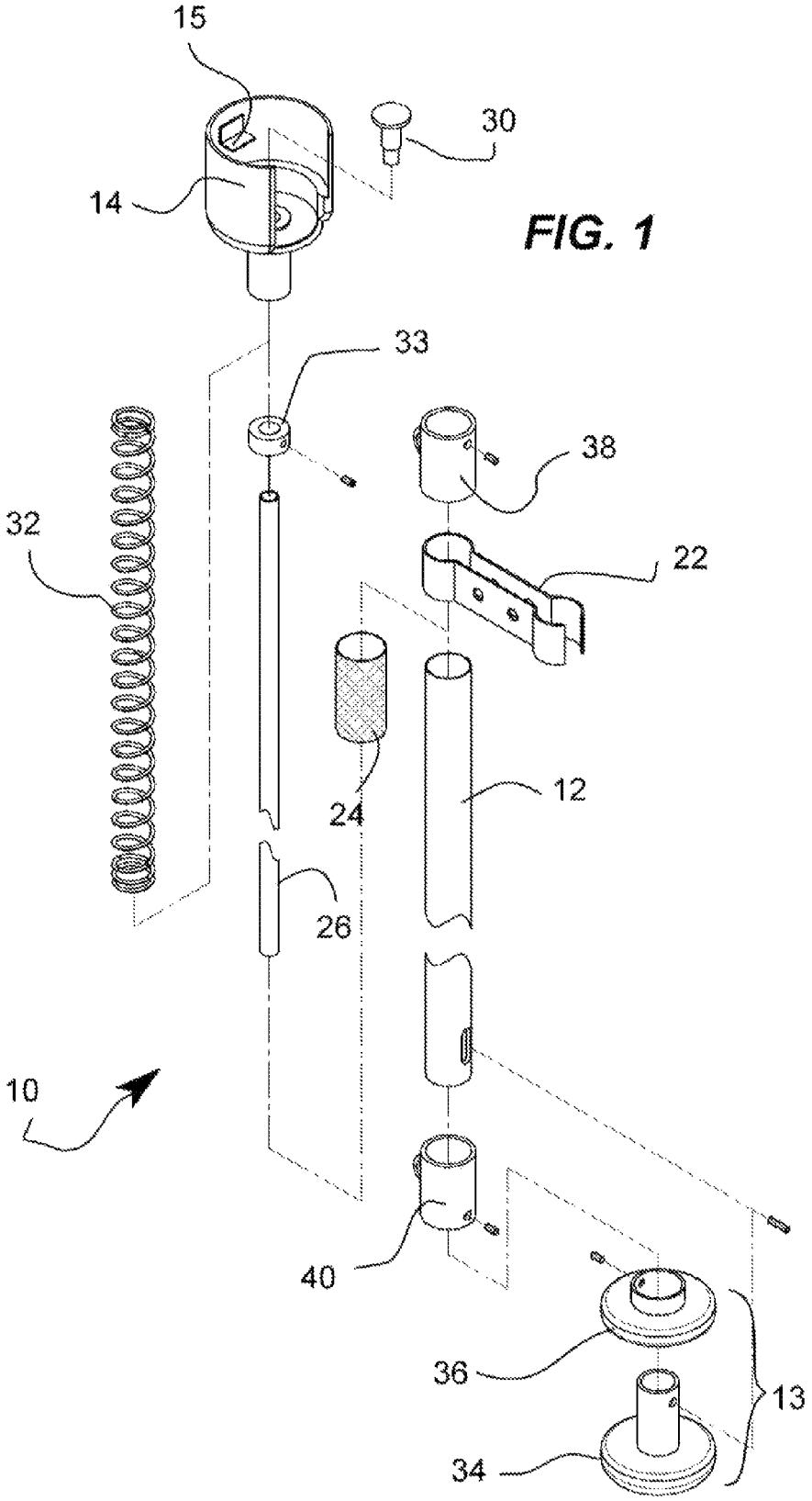
FIG. 1 Exploded view of the invention.
Figure 2:
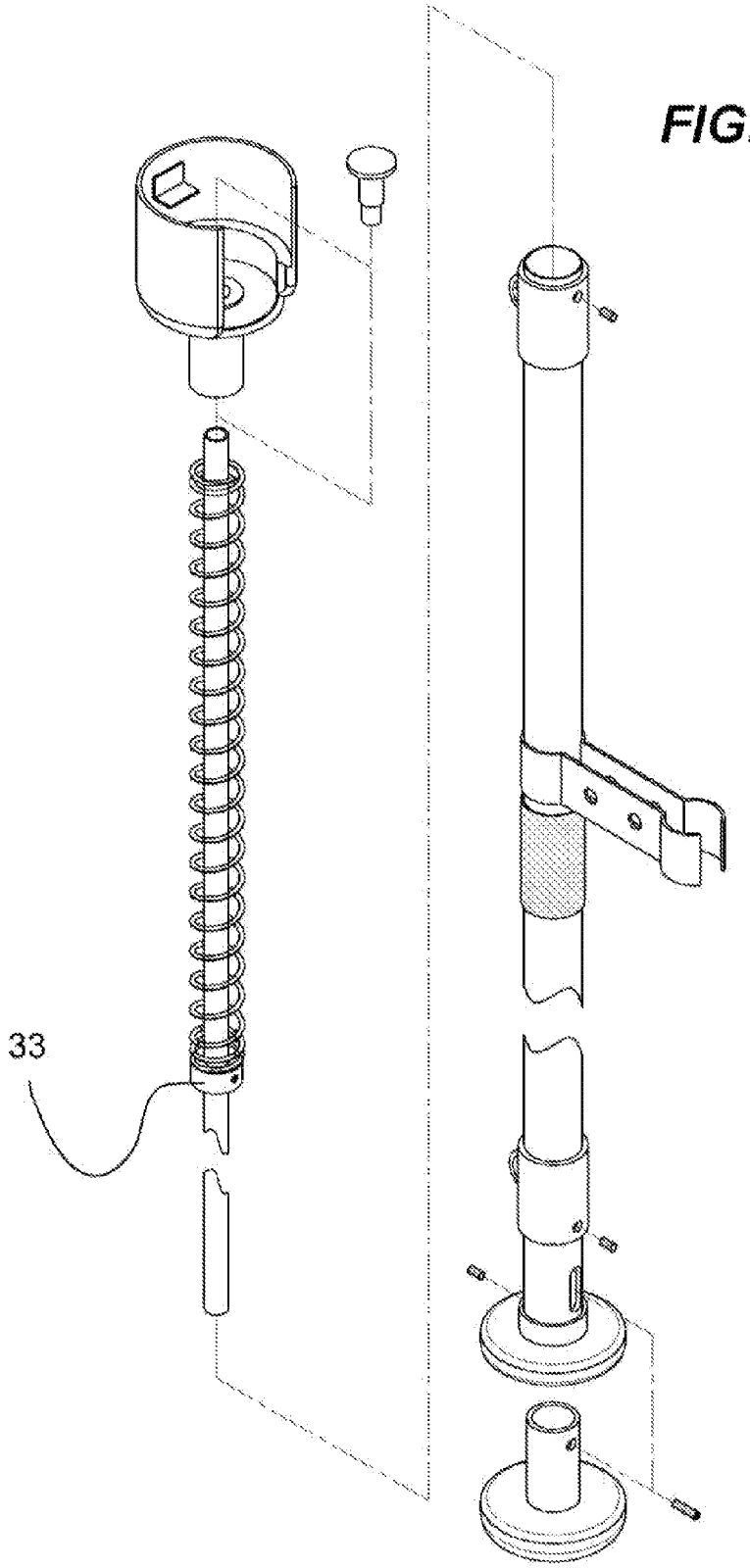
FIG. 2 Exploded view partially assembled.
Figure 4:
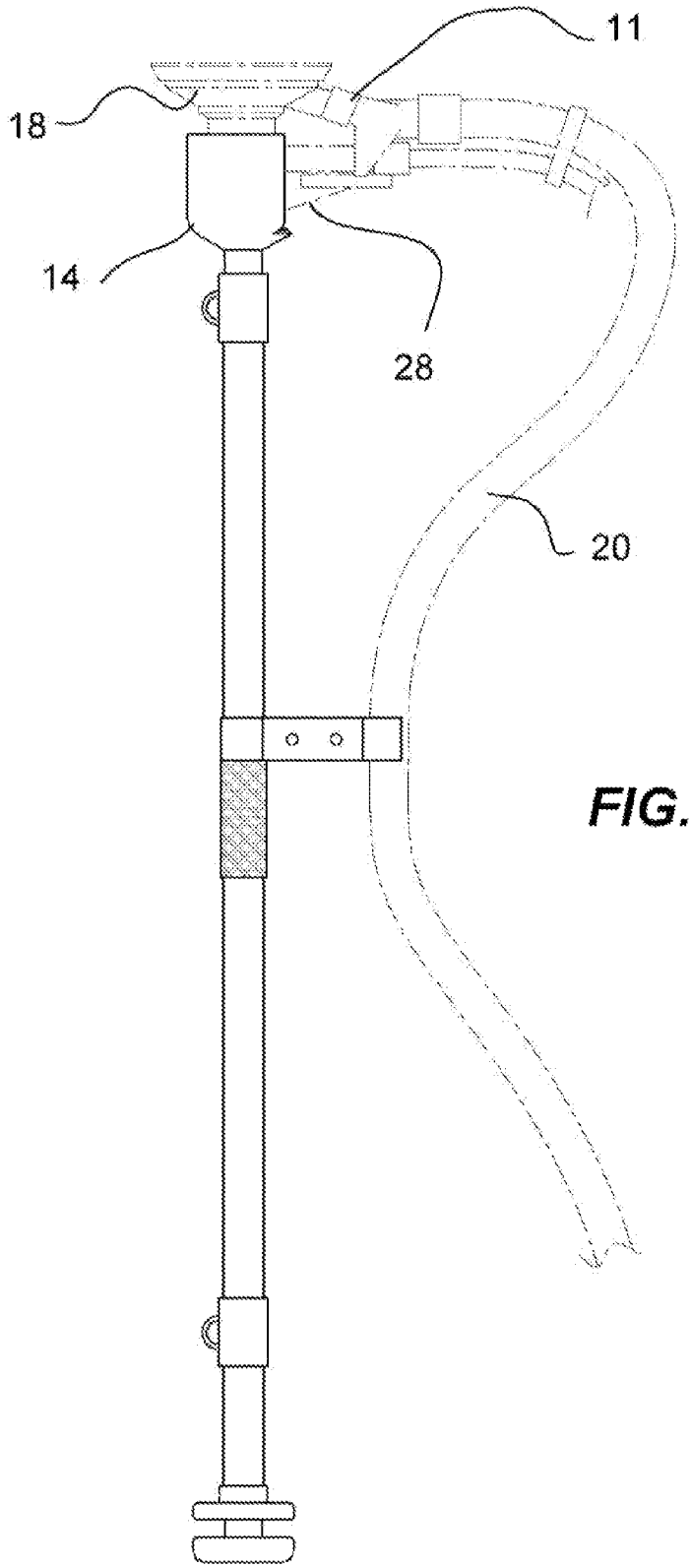
FIG. 4 Side view of the invention with a buffer and hose.
Figures 5A, 5B, 5C, 5D:
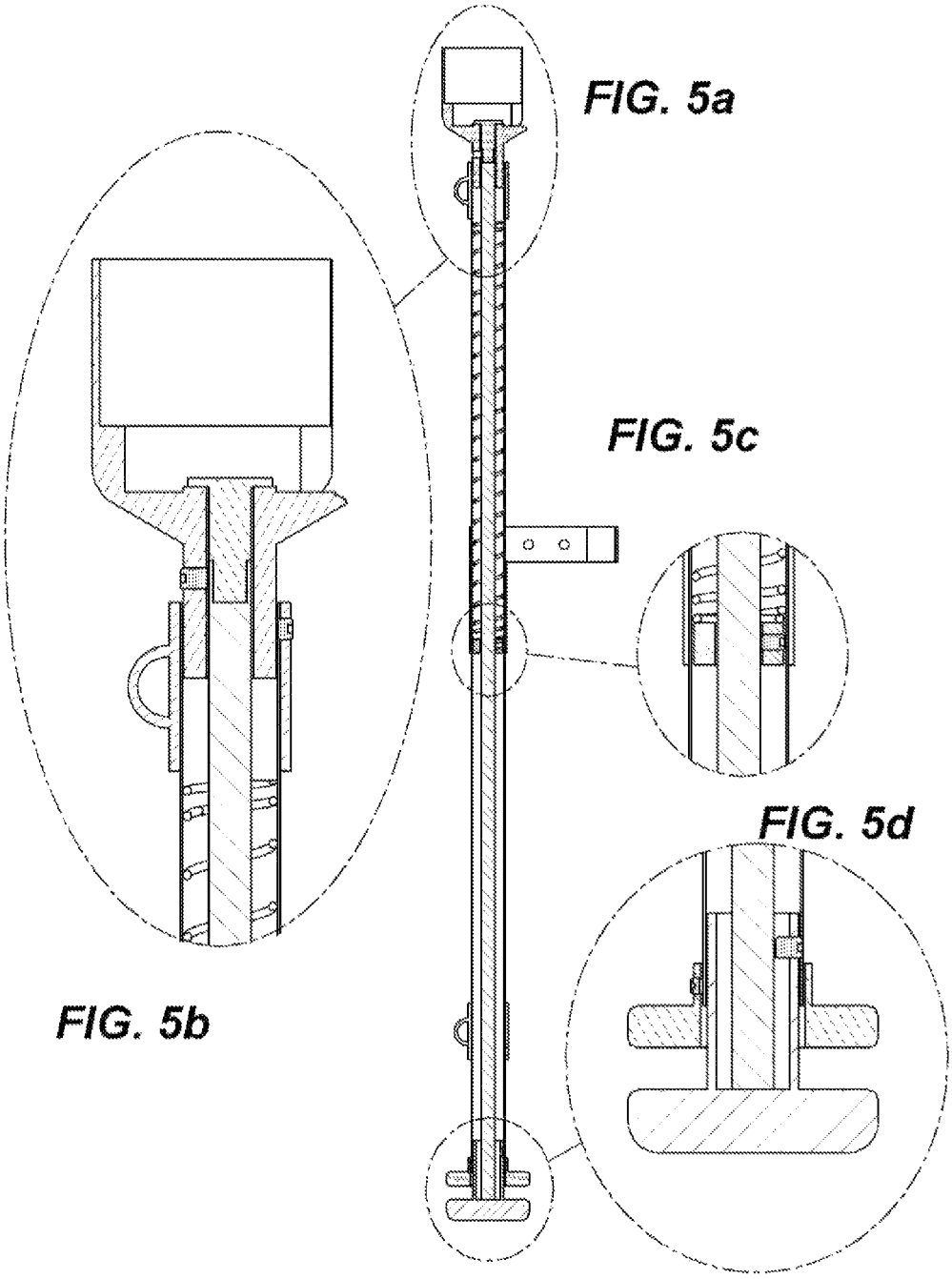
FIGS. 5*a-d* Cutaway side view and cutaway details of the invention.
Figures 6A, 6B:
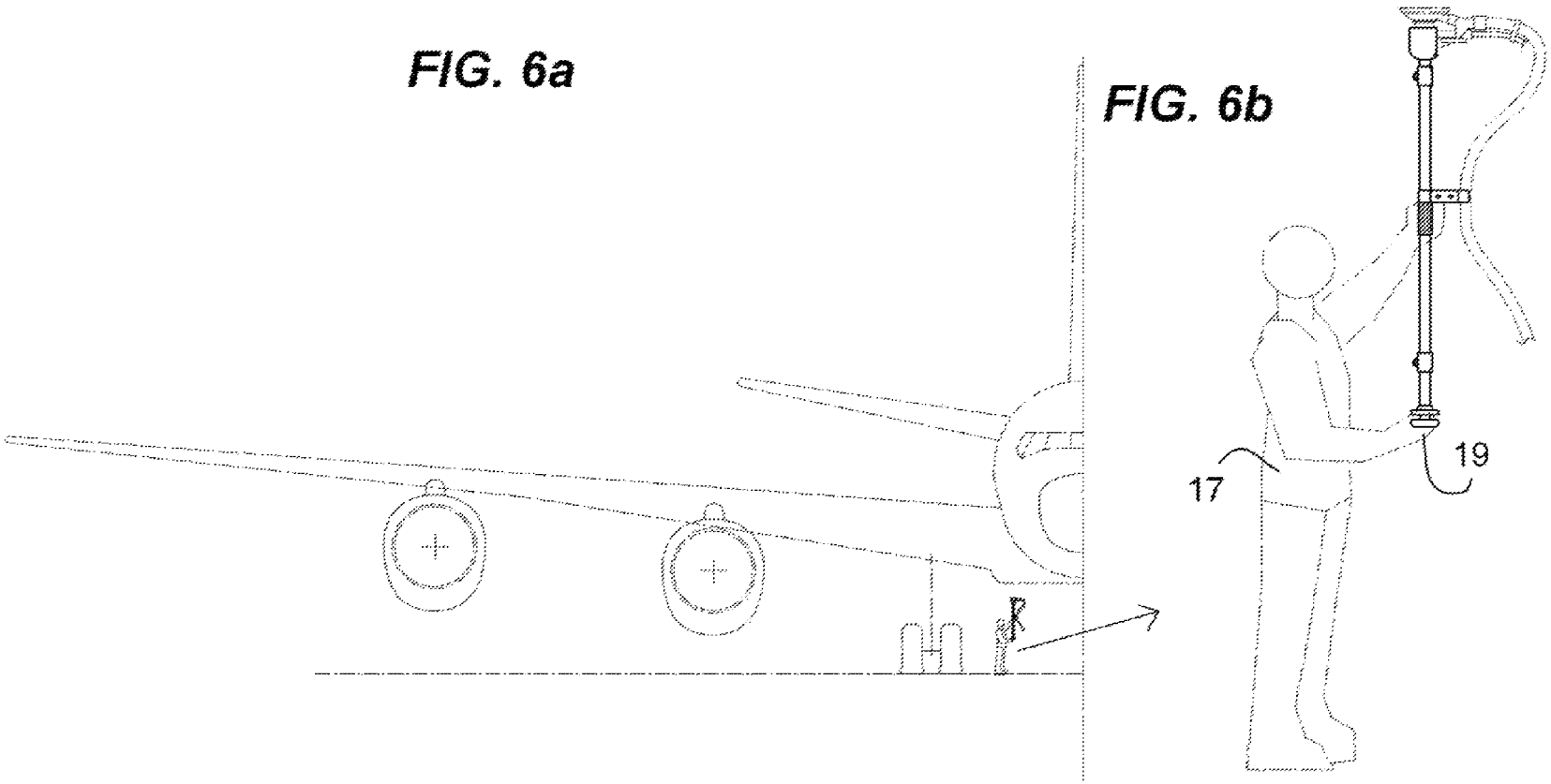
FIGS. 6*a-b* Side views of the invention in context of use.

An extension frame (10) for a pneumatically actuated buffer (11) has a post member (12) having a receptacle (14) at its distal end and a palm handle assembly (13) at its proximal end.

A pneumatically actuated buffer (11) has its head (18) cradled inside the receptacle (14) and supported by a tab member (15). A pneumatic hose (20) is secured to a clamp member (22) itself connected to the post member (12). A handle member (24) is also located on the post member (12).

An intended user (17) puts the palm handle assembly (13) into the palm of his hand (19). The palm handle assembly (13) is comprised of two parts: A bottom part (34) which is movable and an upper part (36) which does not move but allows the user's (17) thumb to rests so that the other fingers can push the bottom part (34) towards the upper part (36) so that a rod member (26) located inside the hollow post member (12) can push a trigger (28) that actuates the buffer (11).

A nipple member (30) located at a distal end of the rod member (26) is what actually depresses the trigger (28) and a biasing member (32) generally in the shape of a coil spring is what biases the rod member (26) down so as to release the trigger (28).

A blocking member (33) blocks the biasing member (32) to a certain length so as to adjust its tension. With a proper biasing member (32) adjustment, the user (17) can control the pressure applied and thus the speed of the buffer (11).

An upper ring (38) rotationally connects the receptacle (14) to the post member (12). A lower ring (40) rotationally connects the post member (12) to the upper part (36).

In operation, a pneumatically actuated buffer (11), including a buffer head (18), a trigger (28) for activating and deactivating the buffer (11), and a pneumatic hose (20) are used in combination with the extension frame (10) so as to facilitate the buffing operation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An extension frame for a pneumatically actuated buffer, comprising an elongated hollow post member; a receptacle removably connected at a distal end of said post member and adapted to releasably hold said buffer thereon; a rod member adapted to be slidably inserted within said post member and having a length that is longer than said post member; a palm handle assembly including an upper part removably connected to a proximal end of said post member, and a bottom part removably connected to a proximal end of said rod member, said palm handle assembly being adapted to push said rod member in a direction toward said receptacle; a biasing member placed between said bottom part of said palm handle assembly and said receptacle and configured to bias said rod member in a direction away from said receptacle; and a nipple member positioned within and extending through a bottom portion of said receptacle, such that when said bottom part of said palm handle assembly is pushed upwards and towards said upper part of said palm handle assembly said rod member is pushed upwards and said nipple member thereby moves upwards and into said receptacle in order to contact a trigger of said buffer to thereby activate said buffer; and wherein when it is desired to deactivate said buffer, said biasing member is adapted and allowed to push said bottom part of said palm handle assembly and thereby said rod member away from said receptacle thereby allowing said nipple member to move downwards and away from said trigger of said buffer to thereby deactivate said buffer.

2. The extension frame of claim 1, wherein said receptacle further includes a tab member adapted to more securely removably hold a head portion of said buffer therein.

3. The extension frame of claim 1, further comprising a handle member attached to an outer surface of said post member and adapted to allow a user to grab said handle member with one hand and said palm handle assembly with their other hand.

4. The extension frame of claim 1, further comprising a clamp member attached to an outer surface of said post member and adapted to releasably hold a pneumatic hose member of said buffer adjacent to said extension frame.

5. The extension frame of claim 1, further comprising an upper ring releasably and adjustably attached between said distal end of said post member and said bottom portion of said receptacle; and a lower ring releasably and adjustably attached between said proximal end of said post member and said upper part of said palm handle assembly, to thereby provide a mechanism to releasably and adjustably hold the respective parts of said extension frame together.

6. The extension frame of claim 1, further comprising a blocking member adapted to be releasably secured to a location upon said rod member and adapted to press and compress said biasing member to a desired tension.

7. The extension frame of claim 1, wherein said biasing member is formed as a coil spring.

8. The extension frame of claim 1, wherein said post member, said bottom portion of said receptacle, said upper and lower parts of said palm handle assembly, said upper and lower rings, are formed in hollow cylindrical shapes.

9. The extension frame of claim 8, wherein said nipple member is formed in a cylindrical shape such that it snugly and slidably fits within said interior of said cylindrical shape of said bottom portion of said receptacle.

10. A combination of a pneumatically actuated buffer and an extension frame, said combination comprising a pneumatically actuated buffer including a buffer head, a trigger for activating or deactivating said buffer, and a pneumatic hose attached thereto; and wherein said extension frame comprises an elongated hollow post member; a receptacle removably connected at a distal end of said post member and adapted to releasably hold said buffer thereon; a rod member adapted to be slidably inserted within said post member and having a length that is longer than said post member; a palm handle assembly including an upper part removably connected to a proximal end of said post member, and a bottom part removably connected to a proximal end of said rod member, said palm handle assembly being adapted to push said rod member in a direction toward said receptacle; a biasing member placed between said bottom part of said palm handle assembly and said receptacle and configured to bias said rod member in a direction away from said receptacle; and a nipple member positioned within and extending through a bottom portion of said receptacle, such that when said bottom part of said palm handle assembly is pushed upwards and towards said upper part of said palm handle assembly said rod member is pushed upwards and said nipple member thereby moves upwards and into said receptacle to contact said trigger of said buffer to thereby activate said buffer; and wherein when it is desired to deactivate said buffer, said biasing member is adapted and allowed to push said bottom part of said palm handle assembly and thereby said rod member away from said receptacle thereby allowing said nipple member to move downwards and away from said trigger of said buffer to thereby deactivate said buffer; and such that said extension frame is used to hold and extend said pneumatically actuated buffer a distance further than a user can by simply holding said buffer with their hands.

11. The combination of claim 10, wherein said receptacle further includes a tab member adapted to more securely removably hold a head portion of said buffer therein.

12. The combination of claim 10, further comprising a handle member attached to an outer surface of said post member and adapted to allow a user to grab said handle member with one hand and said palm handle assembly with their other hand.

13. The combination of claim 10, further comprising a clamp member attached to an outer surface of said post member and adapted to releasably hold a pneumatic hose member of said buffer adjacent to said extension frame.

14. The combination of claim 10, further comprising an upper ring releasably and adjustably attached between said distal end of said post member and said bottom portion of said receptacle; and a lower ring releasably and adjustably attached between said proximal end of said post member and said upper part of said palm handle assembly, to thereby provide as mechanism to releasable and adjustably hold the respective parts of said extension frame together.

15. The combination of claim 10, further comprising a blocking member adapted to be releasably secured to a location upon said rod member and adapted to press and compress said biasing member to a desired tension.

16. The combination of claim 10, wherein said biasing member is formed as a coil spring.

17. The combination of claim 10, wherein said post member, said bottom portion of said receptacle, said upper and lower parts of said palm handle assembly, said upper and lower rings, are formed in hollow cylindrical shapes.

18. The combination of claim 17, wherein said nipple member is formed in a cylindrical shape such that it snugly and slidably fits within said interior of said cylindrical shape of said bottom portion of said receptacle.

* * * * *